United States Patent [19]

Van Noord

[11] Patent Number: 4,541,038

[45] Date of Patent: Sep. 10, 1985

[54] KNOCKDOWN LAMP ASSEMBLY

[76] Inventor: Andrew J. Van Noord, 1434 Hillsboro, SE., Grand Rapids, Mich. 49506

[21] Appl. No.: 531,163

[22] Filed: Sep. 9, 1983

[51] Int. Cl.[3] ..... F21V 1/06

[52] U.S. Cl. ..... 362/352; 362/351; 362/353; 362/360; 362/367

[58] Field of Search ..... 362/351, 352, 353, 360, 362/367

[56] References Cited

U.S. PATENT DOCUMENTS 4,277,822 7/1981 Weber ..... 362/352

FOREIGN PATENT DOCUMENTS 924276 4/1973 Canada ..... 362/352

OTHER PUBLICATIONS

Modulite Corp.; Assembly Instructions for Twin-Lite Pendant Fixture.

*Primary Examiner*—Donald P. Walsh

*Attorney, Agent, or Firm*—Varnum, Riddering, Schmidt & Howlett

[57] ABSTRACT

A knockdown lamp assembly (10) includes a shade (11) comprising a set of separate glass panel sections (12) surrounding an annular lower support frame (52) having an outer channel (60). Interlocking ribs (62) are located inwardly adjacent joints between adjoining panel sections (12) and block direct light from passing outwardly through the joints. The upper ends of the ribs (62) include offset portions (74) which engage slots (44) formed in a central support hub (42) spaced apart from the frame (52). The lower ends of the ribs (62) are received within the channel (60) and include ears (66) maintained beneath a channel shoulder (56) by outwardly adjacent hooks (68) connected to the panel sections (12). An upper holding cap (14) captures the upper portions of the panel sections (12) and a threaded rod (36) mounts the support hub (42) and holding cap (14).

17 Claims, 5 Drawing Figures

KNOCKDOWN LAMP ASSEMBLY

BACKGROUND OF THE INVENTION

1. Field of the Invention

The invention relates to lamp assemblies and, more particularly, to shaded lamp assemblies having a knockdown structure for relative ease of assembly and disassembly.

2. Description of the Prior Art

Many types of lamp assemblies are commercially available for use in home, office and industrial environments. These assemblies can include shades with various ornamental configurations. For example, one type of well-known shaded lamp assembly is commonly referred to as a "Tiffany" lamp, and comprises a lamp shade of ornamental glass first introduced by L. C. Tiffany in the late nineteenth century.

Shaded lamp assemblies such as Tiffany lamps are typically constructed in a substantially unitized manner, so that they must be stored, transported and commercially sold in a fully assembled configuration. For example, the glass shade of a Tiffany lamp is usually constructed in a unitized manner, such as by welding together adjacent metal frames which hold glass panels of the shade. This unitized construction leads to relatively high transport and storage costs due to the bulky configuration of the lamp assemblies. In addition, the bulkiness of the assemblies makes them relatively more difficult to manually carry and securely carton, thereby increasing the chances of damage due to shattering of delicate parts such as the glass shade.

To avoid problems associated with unitized structures, lamp assemblies can be constructed in a knockdown configuration, whereby various parts remain disassembled until purchased and assembled by the ultimate customer. However, when lamp assembly parts such as glass shades are manufactured and sold in separate sections, junctions of some finite space will exist between adjacent sections when fully assembled. That is, the customer cannot be expected to weld or otherwise permanently interconnect the sections together. Furthermore, such permanent interconnection would negate the intended advantage of relative ease of disassembly. Accordingly, knockdown shaded assemblies can have spaces between shade sections which may allow direct light to pass outwardly from an inner light source.

Knockdown assemblies also typically require additional supporting members relative to those required in unitized structures. In lamp assemblies having partially transparent shades, these additional members may cast unwanted shadows.

One type of knockdown shade assembly for a lighting fixture is disclosed in the U.S. Pat. No. 4,277,822 to Weber et al issued July 7, 1981. The Weber et al patent discloses a lighting fixture having a knockdown construction and includes a top hub, a series of flexible plastic ribs fitted into circumferential slots in the hub, an upper horizontal brace made of a single metal wire piece, and a lower brace also formed of a single metal wire piece. Glass or plastic panels fit into openings of the frame formed by the upper and lower braces. The wire pieces are secured to the plastic ribs through hooks on the inside of the ribs. The ribs also form an outwardly extending hook to capture the bottom portion of the glass or plastic panel. Each of the top portions of the panels is captured by a flexible finger on the ribs.

SUMMARY OF THE INVENTION

In accordance with the invention, a knockdown lamp assembly having a light fixture connectible to an electrical power source and shade means comprising a plurality of separate panel sections includes a structural frame assembly having a plurality of elongated interlocking ribs with lower ends and upper ends. The structural frame assembly also includes lower support means having a substantially annular configuration and including means for detachably receiving the lower ends of the ribs. Upper rib support means are mounted to a central support assembly and spaced apart from the lower support means to detachably receive the upper ends of each of the ribs. Holding cap means are located above the rib support means for detachably retaining the upper portions of the panel sections, and each of the panel sections includes securing means received within the lower support means to support the panel sections and maintain and lock the lower ends of the ribs within the lower support means.

The interlocking ribs are located inwardly adjacent joints formed between adjoining panel sections so as to block direct light from passing through the joints. The ribs radially project from the upper rib support means at a downward angle therefrom.

The means for detachably receiving the lower ends of the ribs includes a channel open at its top portion, with an inner shoulder extending partially along the top portion. Each of the ribs includes a set of ears extending inwardly from the lower rib end, and the panel section securing means maintains the ears beneath the inner channel shoulder so as to lock the ribs within the channel. The panel section securing means can comprise downwardly extending hooks at each side of the panel sections, wherein each of the hooks is received within the channel outwardly adjacent to the lower ends of the ribs.

In accordance with one aspect of the invention, the lower support means can comprise a frame in the shape of a regular polygon having a plurality of corners. The lower end of each of the ribs comprises a V-shaped portion conforming to the shape of a frame corner when received within the channel. One hook from each of two adjoining panel sections is received within the channel outwardly adjacent the V-shaped portion of the lower rib end. In one embodiment of the invention, the number of sides of the regular polygon is equal to twice the number of separate panel sections.

The upper rib support means includes a horizontally disposed hub having a plurality of slots. The upper end of each of the ribs includes an offset portion received within different ones of the slots. The holding cap means comprises a bell-shaped cap having an outer circular edge, with the cap being vertically adjustable relative to the lower support means to exert downward forces on the detachably retained upper ends of the panel sections. The central support member comprises a threaded rod extending upwardly from the light fixture, and the bell-shaped cap and horizontally disposed hub are mounted to the threaded rod.

The threaded rod is hollow so as to receive electrical wires connected to the light fixture and adapted to be connected to the power source. The panel sections can include separate glass or plastic panels mounted within metallic frames, wherein the metallic frames mounting adjacent panels of one panel section are soldered together so as to block direct light from passing between joints thereof.

BRIEF DESCRIPTION OF THE DRAWING

The invention will now be described with reference to the drawing in which.

DESCRIPTION OF THE PREFERRED EMBODIMENTS

Figure 1:
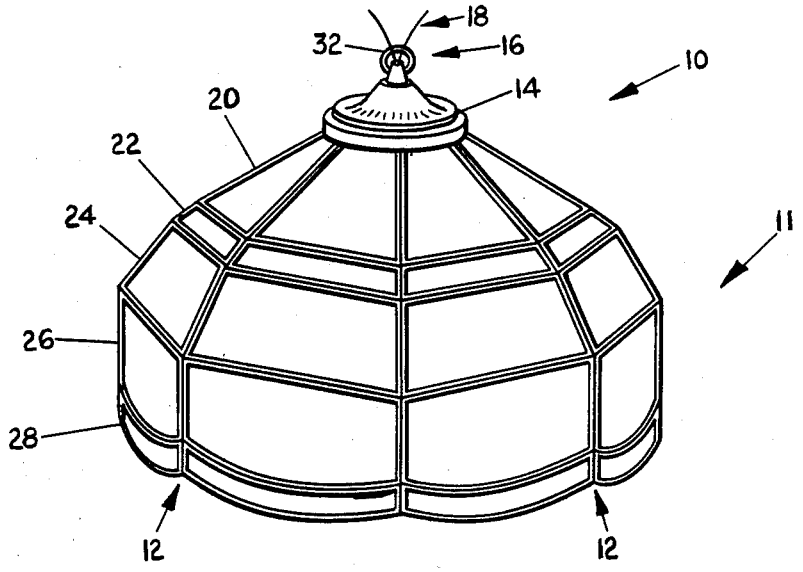
FIG. 1 is a perspective view of a knockdown lamp assembly in accordance with the invention.

The principles of the invention are disclosed, by way of example, in a knockdown lamp assembly 10 as depicted in FIG. 1. The assembly 10 includes a shade 11 surrounding a central light fixture 48 (shown in FIG. 4) interconnected to a set of electrical wires 18 projecting upwards through a holding cap 14 and support ring assembly 16. The wires 18 are adapted to interconnect the light fixture 48 to a conventional residential or commercial electrical power source. The support ring assembly 16 can be secured to a hook, chain or other type of suspension means, and allows the lamp assembly 10 to be physically mounted to a ceiling or other structure as desired.

The shade 11 is in the shape of a polyhedron and includes a set of four panel sections 12 to provide shading of direct light from a bulb secured within the light fixture 48. Each panel section 12 is separate from other sections 12 for relative ease of storage, transport, assembly and disassembly, and includes a pair of adjacent upper glass panels 20. Depending downwardly at an angle relative to the upper panels 20 are a pair of upper smaller panels 22. Similarly, intermediate glass panels 24 depend downwardly from the smaller panels 22, and vertically disposed glass panels 26 depend downwardly from the intermediate panels 24. Secured to the bottom of the vertically disposed glass panels 26 are a pair of lower end panels 28.

The glass panels can be manufactured of colored translucent glass, such as that found in conventional Tiffany lamps. Alternatively, the various panels of panel sections 12 may be constructed of a plastic or other type of material having a consistency and transparency as desired for shading of direct light. In addition, although the lamp assembly 10 described herein is comprised of four panel sections 12 and forms an octagonal lateral cross section as depicted in FIG. 2, any number, size and shape of panel sections 12 can be employed in accordance with the invention.

Figure 2:
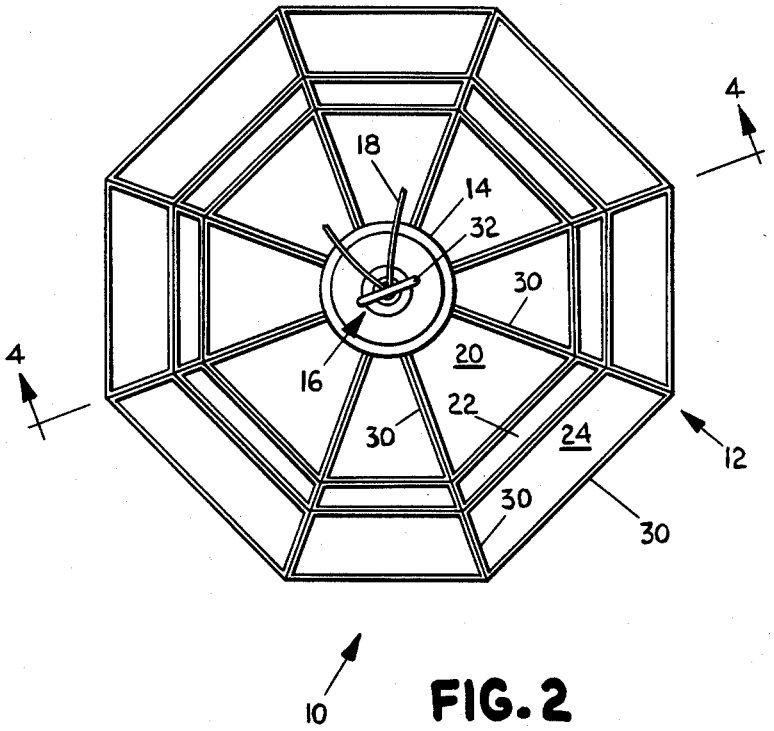
FIG. 2 is a plan view of the knockdown lamp assembly shown in FIG. 1.
Figure 4:
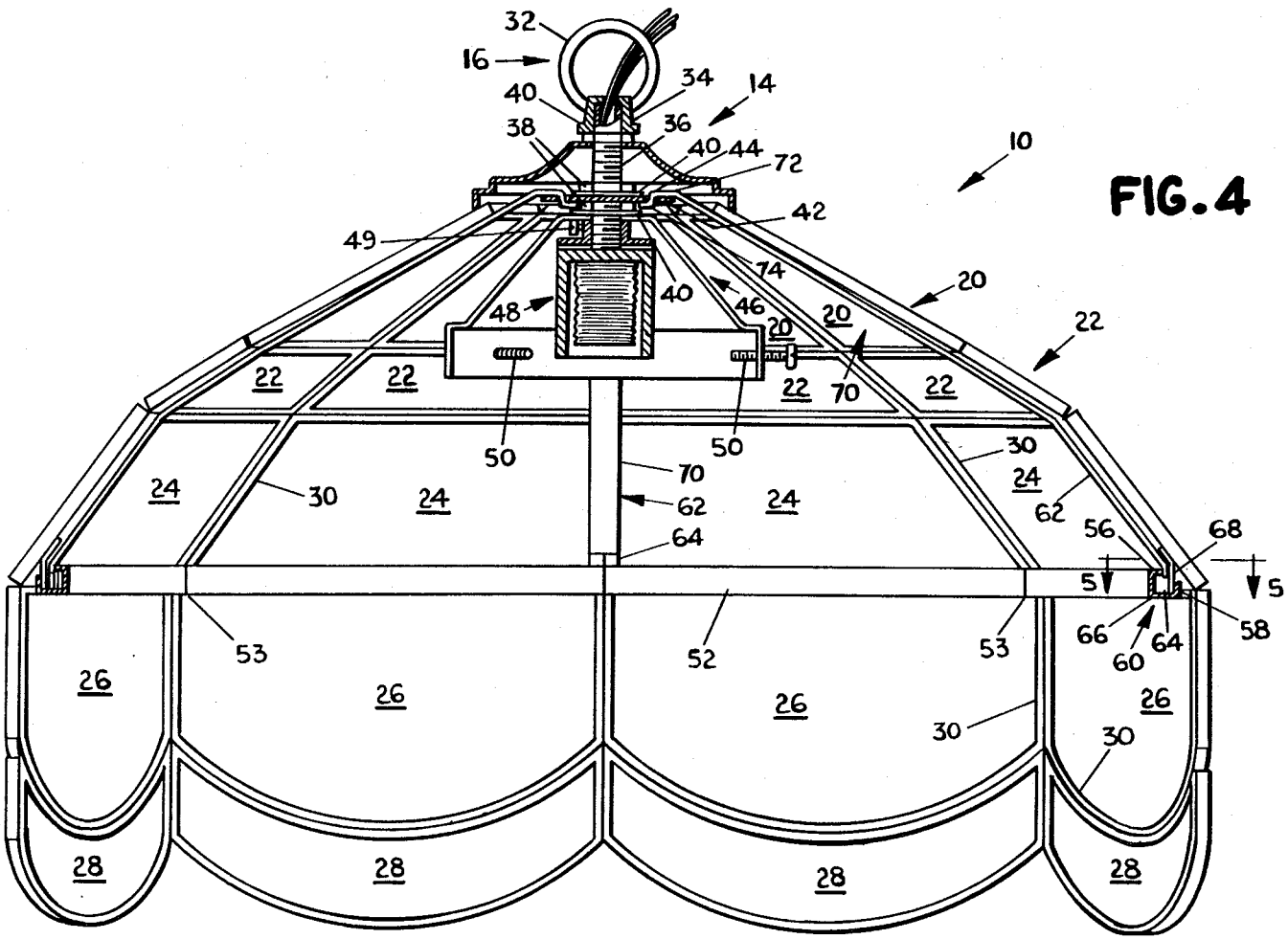
FIG. 4 is a sectional side view of the knockdown lamp assembly taken along lines 4—4 of FIG. 2.

As depicted in FIGS. 2 and 4, each of the panel sections 12 includes metallic frames 30 surrounding the previously described glass panels 20, 22, 24, 26 and 28. To rigidly secure adjacent glass panels, and to prevent direct light from passing between the glass panels, the metallic frames 30 associated with one panel section 12 can be connected by solder joints or other suitable securing means.

Figure 3:
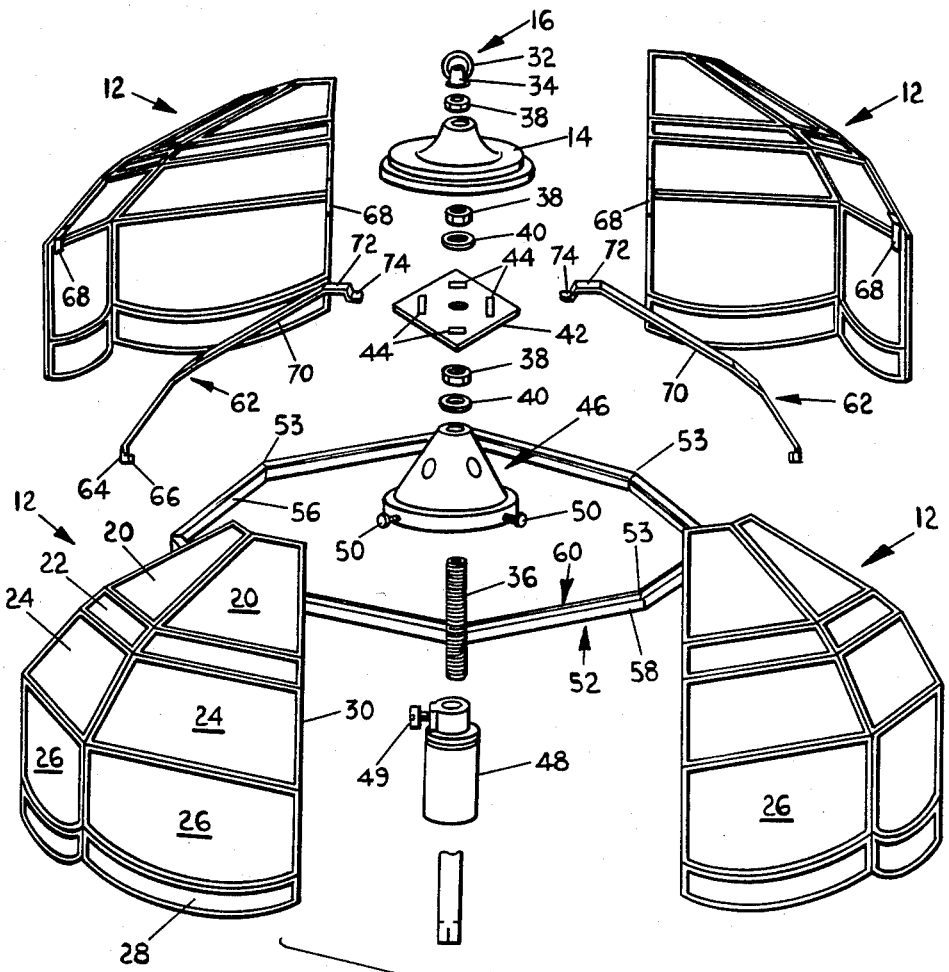
FIG. 3 is an exploded view of the knockdown lamp assembly shown in FIG. 1.

Referring to FIGS. 2, 3, and 4, the support ring assembly 16 includes a ring 32 secured to an internally threaded lower cap 34. As shown in FIG. 4, a hollow threaded rod 36 threadably engages the lower cap 34 and secures the support ring assembly 32. The wires 18 project upwardly through the threaded rod 36.

Located below the support ring assembly 16 is the glass holding cap 14 having a substantially bell-shaped configuration as depicted in FIG. 3. When assembled as shown in FIG. 4, the threaded rod 36 extends through a central aperture in the holding cap 14. As apparent from subsequent description herein, the holding cap 14 secures the panel sections 12 in a rigid manner when the lamp assembly 10 is fully assembled.

Referring again to FIG. 4, a rectangular rib support hub 42 is received on the threaded rod 36 below the holding cap 14 through a central aperture in the hub 42. The support hub 42 is secured in a predetermined position on the threaded rod 36 by means of nuts 38 and lock washers 40. As best depicted in FIG. 3, the hub 42 includes a rib slot 44 positioned at each of the four corners of the hub 42.

Referring to FIGS. 3 and 4, the lower end of the threaded rod 36 extends through a central aperture of a bell-shaped lamp shield 46. The lamp shield 46 surrounds a conventional ceramic light fixture 48 adapted to receive a bulb (not shown) and secured to rod 36 by set screw 49. The wires 18 extend through the threaded rod 36 and electrically connect contacts (not shown) within the light fixture 48 to a source of electrical power. To provide additional shading of the bulb if desired, support screws 50 are provided in the lower lateral surface of the lamp shield 46 to provide a means for securing a conventional glass bulb shade or similar shading means. The threaded rod 36 and various nuts 38 and washers 40 can be characterized as a central support member for mounting the light fixture 48, hub 42, holding cap 14 and support ring assembly 16.

Referring again to FIGS. 3 and 4, the lamp assembly 10 also includes a lower support frame 52 having a configuration substantially conforming to the configuration of the shade 11 formed by the panel sections 12. In the lamp assembly 10 described herein, the support frame 52 is of an octagonal shape with corners 53 as depicted in FIG. 3. As shown in cross-section in FIG. 4, the support frame 52 includes an outer channel 60 open at its top portion, with an outer vertically disposed wall 58 and a horizontally projecting shoulder or lip 56 extending partially along the channel top portion. The frame 52 can be of a metallic construction and, for example, may be formed as a unitary aluminum extrusion.

Figure 5:
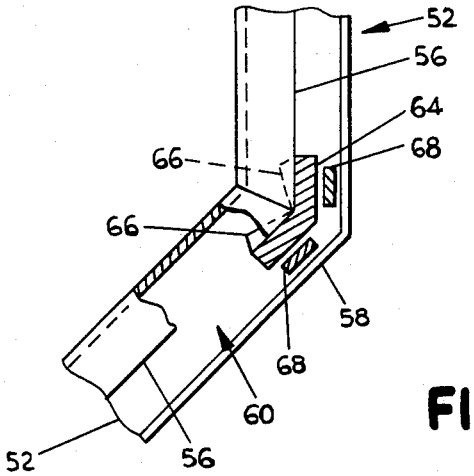
FIG. 5 is a sectional enlarged top view of the interconnection of panel sections, a rib and the frame of the knockdown lamp assembly, taken along lines 5—5 of FIG. 4.

Secured between the upper rib support hub 42 and the lower support frame 52 are a set of four interlocking ribs 62, each equally spaced from adjoining ribs. As shown in FIG. 4, the upper end of each of the ribs 62 includes an offset portion 74 hooked into one of the slots 44 of the support hub 42. Each rib 62 further includes a relatively short horizontal portion 72 extending from the offset portion 74, and an elongated central portion 70 angled downwardly and outwardly from the horizontal portion 72. The lower end of each of the ribs 62 terminates in a vertical portion 64 bent into a V-shaped configuration substantially conforming to the angle formed at each of the frame corners 53. The V-shaped portions 64 are received within the channel 60 of frame 52 at four equally spaced apart frame corners 53. To provide a means for locking each of the ribs 62 within the channel 60, a pair of ears 66 project inwardly from the portion 64 and are configured so as to fit in the channel 60 beneath the shoulder 56. The cross-sectional shapes of the V-shaped portion 64 and ears 66 are shown in FIG. 5. The frame 52 can be characterized as a lower support means having a channel 60 which can be characterized as means for detachably receiving the V-shaped portions 64 of ribs 62. Correspondingly, the upper support hub 42 can be characterized as an upper rib support means for detachably receiving upper ends of the ribs 62.

As shown in FIGS. 3 and 4, panel hooks 68 extend downwardly from the lateral edges of each panel section 12. Referring to FIG. 4, one panel hook 68 from each of two adjoining panel section lateral edges is received within the channel 60 outwardly adjacent the V-shaped portion 64 of a corresponding rib 62. When the lamp assembly 10 is fully assembled, the panel hooks 68 block the space adjacent to the adjoining ribs 62 so as to maintain and lock the ears 66 beneath the shoulder 56. The relative positions of two adjoining hooks 68, ears 66 and V-shaped portion 64 of a rib 62 are shown in FIG. 5. The hooks 68 can be characterized as a securing means detachably received within channel 60 to support the panel sections 12 and maintain and lock the V-shaped portions 64 and ears 66 of ribs 62 within the channel 60.

As shown in FIG. 4, the upper end of each panel section 12 is detachably retained under the glass holding cap 14. The panel sections 12 extend at an angle downwardly from the cap 14 outwardly adjacent the ribs 62. The ribs 62 substantially conform to the vertical cross-sectional shape of the glass panels of sections 12 and are located at the joints between adjoining panel sections 12 so as to block direct light from passing through the joints. The holding cap 14, upper rib support hub 42, ribs 62 and frame 52 can be characterized as a structural frame assembly for mounting the shade 11.

The assembly of the lamp assembly 10 will now be described with respect to FIG. 3. In accordance with the invention, the lamp assembly 10 may be manually assembled by the ultimate customer without the need of complex tools. Furthermore, the various components of the lamp assembly 10 can be stored in a relatively compact manner when the assembly 10 is disassembled. For example, the panel sections 12 can be constructed so as to nest together during storage.

When the assembly 10 is purchased by the ultimate customer, the bell-shaped light socket holder 46, associated light fixture 48 (shown in FIG. 4), and threaded rod 36 can preferably be previously assembled together. In addition, it can also be preferable to have the rib support hub 42 previously secured to the threaded rod 36 by means of the nuts 38 and lock washers 40. The remaining portions of the lamp assembly 10 depicted in FIG. 3 can be maintained separately until final assembly.

During final assembly, the wires 18 extending upwardly from the threaded rod 36 can be threaded through the central aperture of holding cap 14, nut 38 and the cap 34 of support ring assembly 16. Next, the ribs 62 can be secured in an equally spaced manner between the central frame 52 and the upper rib support hub 42. As previously described, the upper ends of the ribs 62 each include an offset portion 74 which can be secured into one of the slots 44 of support hub 42. The lower portions of the four ribs 62, namely the V-shaped portions 64, can be secured at every other corner of the support frame 52, with the ears 66 positioned beneath the shoulder 56 as shown in FIG. 5. With the ribs 62 thus positioned, the support hub 42, threaded rod 36 and the light fixture 48 will be maintained above and spaced apart from the lower support frame 52.

Next, the panel sections 12 can be positioned in a manner surrounding the support frame 52 and ribs 62 so that two panel hooks 68 of adjoining panel sections 12 are secured within the channel 60 of frame 52 immediately outward from a corresponding rib 62 as shown in FIG. 5. In this manner, each of the ribs 62 will prevent direct light from passing through spaces formed between adjoining panel sections 12.

The glass holding cap 14 can then be secured onto the threaded rod 38 and positioned in the manner shown in FIG. 4 so that the upper ends of the panel sections 12 are detachably retained under the cap 14. By tightening down the upper hex nut 38 shown in FIG. 3 onto the threaded rod 36, the cap 14 exerts forces on the panel sections 12 so that the panel hooks 68 correspondingly exert forces downwardly against the bottom portion of frame 52 inside the outer wall 58 of frame 52 thereby securely fastening the lower portion of panels 12 in place. The pressure of the panel hooks 68 adjacent to the bottom ends of the ribs 62 block the path of entry of the ribs 62 into the frame 52, thereby maintaining the ears 66 beneath the shoulder 56 of frame 52 so as to securely lock the panel sections 12 into a fully assembled position. As a final step, the support ring assembly 16 is threaded onto the upper end of the threaded rod 36. The customer can then electrically connect the wires 18 to a source of electrical power and suspend the lamp assembly 10 to a ceiling or similar structure as desired. It will be apparent that various types of conventional switch means can also be included in the structure to selectively turn the lamp assembly 10 on and off. Disassembly of the lamp assembly 10 can be performed by reversing the assembly steps described above.

It should be noted that the ribs 62 will not only block any direct light from passing through joints between the panel sections 12, but are also of a sufficiently narrow width and are positioned so as to avoid the formation of shadows on the glass panels of the shade 11.

It will be apparent to those skilled in the pertinent art that modifications and other variations of the above-described illustrative lamp assembly 10 in accordance with the invention can be implemented. For example, as previously described, the number, size and shape of the panel sections 12 can be varied. Correspondingly, the number of ribs 62, size and shape of support frame 52, and size and shape of support hub 42 and cap 14 can also be varied. In addition, the panel sections 12 can be constructed of glass, plastic or other materials providing desired transparency and aesthetic features. That is, the principles of a lamp assembly in accordance with the invention are not limited to the specific embodiment herein. Modifications and other variations of the above-described illustrative embodiment of the invention may be effected without departing from the spirit and the scope of the novel concepts of the invention.

The embodiments of the invention in which an exclusive property or privilege is claimed are defined as follows:

1. In a knockdown lamp assembly having a light fixture adapted to be electrically connected to a power source, shade means comprising a plurality of separate panel sections, and a knock down structural frame assembly mounting the shade means and comprising a central support member, the improvement comprising:

the structural frame assembly further including:

a plurality of elongated interlocking ribs, each having a lower end and an upper end;

lower support means having a substantially annular and continuous configuration separate from the ribs for providing a bracing support for the shade means, and comprising rib and panel section receiving means for detachably receiving and supporting the panel sections and the lower ends of the ribs;

upper rib support means mounted to the central support member and spaced apart from the lower support means for detachably receiving the upper end of each of the ribs; and holding cap means mounted to the central support member and located above the upper rib support means for detachably retaining upper portions of each of the panel sections; and wherein each of the panel sections comprises rigidly attached securing means separate from the lower support means and the ribs, and detachably received within the rib and panel section receiving means of the lower support means to support the panel sections and to maintain and lock the lower ends of the ribs within the lower support means.

2. A knockdown lamp assembly in accordance with claim 1 wherein each of the interlocking ribs is located inwardly adjacent joints formed between adjacent panel sections so as to block direct light from passing through the joints.

3. A knockdown lamp assembly in accordance with claim 1 wherein:

the means for detachably receiving the lower ends of the ribs comprises a channel open at its top portion with an inner shoulder extending partially along the top portion;

each of the interlocking ribs includes a set of ears extending inwardly from the lower ends of the ribs; and the panel section securing means maintains the ears beneath the inner shoulder so as to lock the ribs within the channel.

4. A knockdown lamp assembly in accordance with claim 3 wherein the panel section securing means comprises downwardly extending hooks at each side of each of the panel sections, wherein each of the hooks is received within the channel outwardly adjacent to the lower end of one of the ribs.

5. A knockdown lamp assembly in accordance with claim 4 wherein:

the lower support means further comprises a frame in the shape of a regular polygon having a plurality of corners;

the lower end of each of the ribs is bent into a V-shaped portion so as to conform to the shape of a frame corner when received within the channel; and one panel section hook from each of two adjoining panel sections is received within the channel outwardly adjacent the V-shaped portion of the lower end of one of the ribs.

6. A knockdown lamp assembly in accordance with claim 5 wherein the number of sides of the regular polygon frame is equal to twice the number of separate panel sections.

7. A knockdown lamp assembly in accordance with claim 1 herein;

the upper rib support means comprises a horizontally disposed hub having a plurality of slots; and the upper end of each of the ribs includes an offset portion received within different ones of the slots.

8. A knockdown lamp assembly in accordance with claim 7 wherein the central support member comprises a threaded rod extending upward from the light fixture, and the horizontally disposed hub is centrally mounted on the rod above the light fixture.

9. A knockdown lamp assembly in accordance with claim 1 wherein the holding cap means comprises a bell-shaped cap having an outer circular edge, the cap being vertically adjustable relative to the lower support means for exerting downward forces on the detachably retained upper portions of the panel sections so as to rigidly secure the panel sections.

10. A knockdown lamp assembly in accordance with claim 9 wherein the central support member comprises a threaded rod extending upward from the light fixture, and the bell-shaped cap is centrally mounted on the rod above the light fixture and upper rib support means.

11. A knockdown lamp assembly in accordance with claim 1 wherein the ribs project radially outward and are downwardly angled from the upper rib support means.

12. A knockdown lamp assembly in accordance with claim 1 wherein each of the ribs comprises an elongated central portion located adjacent to a corresponding panel section joint and substantially conforming to the shape of the panel section so as to avoid generation of rib shadows on the panel sections.

13. A knockdown lamp assembly in accordance with claim 1 wherein the central support member comprises a threaded rod extending upward from the light fixture, and a support ring threadably received on the upper end of the threaded rod.

14. A knockdown lamp assembly in accordance with claim 13 wherein the upper rib support means comprises a slotted horizontally disposed hub secured to the threaded rod above the light fixture, and the holding cap means comprises a bell-shaped cap secured to the threaded rod above the support hub.

15. A knockdown lamp assembly in accordance with claim 13 wherein the threaded rod is hollow and the lamp assembly further comprises a set of electrical wires connected to the light fixture and extending upwardly through the threaded rod for interconnecting the light fixture to the power source.

16. A knockdown lamp assembly in accordance with claim 1 wherein each of the panel sections comprises a set of glass or plastic panels mounted within metallic frames, wherein the metallic frames on one of the panel sections are soldered together so as to avoid direct light from passing through joints between the metallic frames.

17. A knockdown lamp assembly in accordance with claim 1 wherein:

the lower support means comprises a frame constructed as a unitary extrusion in the shape of a regular polygon having a plurality of corners and the means for detachably receiving the lower ends of the ribs comprises a channel open at its top portion with an inner shoulder projecting outwardly partially along the top portion;

the upper rib support means comprises a horizontally disposed hub having a plurality of slots, wherein the upper end of each of the ribs is received within different ones of the slots;

the lower end of each of the ribs includes a V-shaped portion substantially conforming to the shape of a corner of the frame, and a set of ears extending inwardly from the V-shaped portion, wherein the V-shaped portion is received within the channel at a frame corner;

the panel section securing means comprises downwardly extending hooks received within the frame channel and located immediately outward from sides of the V-shaped portions, wherein the hooks maintain the ears of the ribs beneath the channel shoulder so as to securely lock the ribs within the channel; and the holding cap means comprises a bell-shaped holding cap having an outer lower circular edge abutting the upper portions of the panel sections.

* * * * *